US009717647B1

(12) United States Patent
Holtsnider et al.

(10) Patent No.: US 9,717,647 B1
(45) Date of Patent: Aug. 1, 2017

(54) OCCUPANT ACTUATED HYDROTHERAPY JET

(71) Applicant: Waterway Plastics, Oxnard, CA (US)

(72) Inventors: Mike D. Holtsnider, Moorpark, CA (US); Jason Hillyard, Fillmore, CA (US)

(73) Assignee: Waterway Plastics, Oxnard, CA (US)

( * ) Notice: Subject to any disclaimer, the term of this patent is extended or adjusted under 35 U.S.C. 154(b) by 67 days.

(21) Appl. No.: 14/844,201

(22) Filed: Sep. 3, 2015

(51) Int. Cl.
*A61H 33/00* (2006.01)

(52) U.S. Cl.
CPC ..... *A61H 33/6052* (2013.01); *A61H 33/0087* (2013.01)

(58) Field of Classification Search
CPC ..... A61H 33/0087; A61H 33/6052; A61H 33/60; A61H 33/601; A61H 33/6021
See application file for complete search history.

(56) References Cited

U.S. PATENT DOCUMENTS 2,938,517 A * 5/1960 Friend ..... A61H 9/00 601/157
3,477,687 A * 11/1969 Doutt ..... F16K 3/243 251/100
4,047,527 A * 9/1977 Kelsen ..... A61H 13/005 601/162
5,045,055 A * 9/1991 Gonser ..... A61C 1/18 137/454.2

* cited by examiner

*Primary Examiner* — J. Casimer Jacyna
(74) *Attorney, Agent, or Firm* — Sandy Lipkin

(57) ABSTRACT

An occupant-actuated massager for a hydrotherapy vessel. The massager jet has an actuation point at which the occupant applies force to cause the pressurized water to flow therethrough and provide a massage via a shuttle. A valve piston is actuated to open and close based on the application of force to the actuation point. Optionally, a venturi can be used to introduce air into the water flow to provide further massage.

6 Claims, 11 Drawing Sheets

OCCUPANT ACTUATED HYDROTHERAPY JET

BACKGROUND OF THE INVENTION

Field of the Invention

The field of this invention relates generally to the field of massagers and more specifically toward a massaging jet that is actuated through pressure applied by the occupant in a hydrotherapy vessel.

Description of the Prior Art

Hydrotherapy vessels are used to provide therapeutic care of the body in water when the body is sore or fatigued. Massage is another therapy used to provide body care in similar instances. The combination of these two treatments is advantageous and the instant invention seeks to provide an apparatus that uses a combination of these two therapies.

Typically jets in hydrotherapy vessels are turned on and off from a source near or outside the vessel. They can also be actuated by rotating the escutcheon on and off.

It is the object of the instant invention to provide a jet for a hydrotherapy vessel that is actuated inside of the vessel through the application of force onto the hydrotherapy jet either on the shuttle or the escutcheon by an occupant therein.

SUMMARY OF THE INVENTION

The basic embodiment of the present invention teaches an occupant-actuated hydrotherapy jet for a hydrotherapy vessel comprising: an internal housing assembly further comprising: a valve seat; an internal sleeve assembly housing inside of said internal housing assembly further comprising: a piston sleeve; a valve piston at the bottom of said piston sleeve; a valve piston seal between said valve piston and said piston sleeve; actuation point contactable with said piston sleeve; wherein when pressure is applied to said actuation point, pressure is further applied to said piston sleeve thereby causing said valve piston and said valve piston seal to separate from said valve seat thereby allowing the flowing of pressurized water therethrough and wherein when pressure on said actuation point is released said flowing of pressurized water is discontinued.

The above embodiment can be further modified by defining that said actuation point is on a shuttle.

The above embodiment can be further modified by defining that said actuation point is on an escutcheon extension.

The above embodiment can be further modified by defining that said actuation point is on a hydrotherapy massage apparatus.

The above embodiment can be further modified by defining that said valve piston is sized to create resistance to said force applied by said occupant as the surface area of said valve piston relates to its diameter and is acted upon by a predetermined water pressure in said hydrotherapy vessel.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
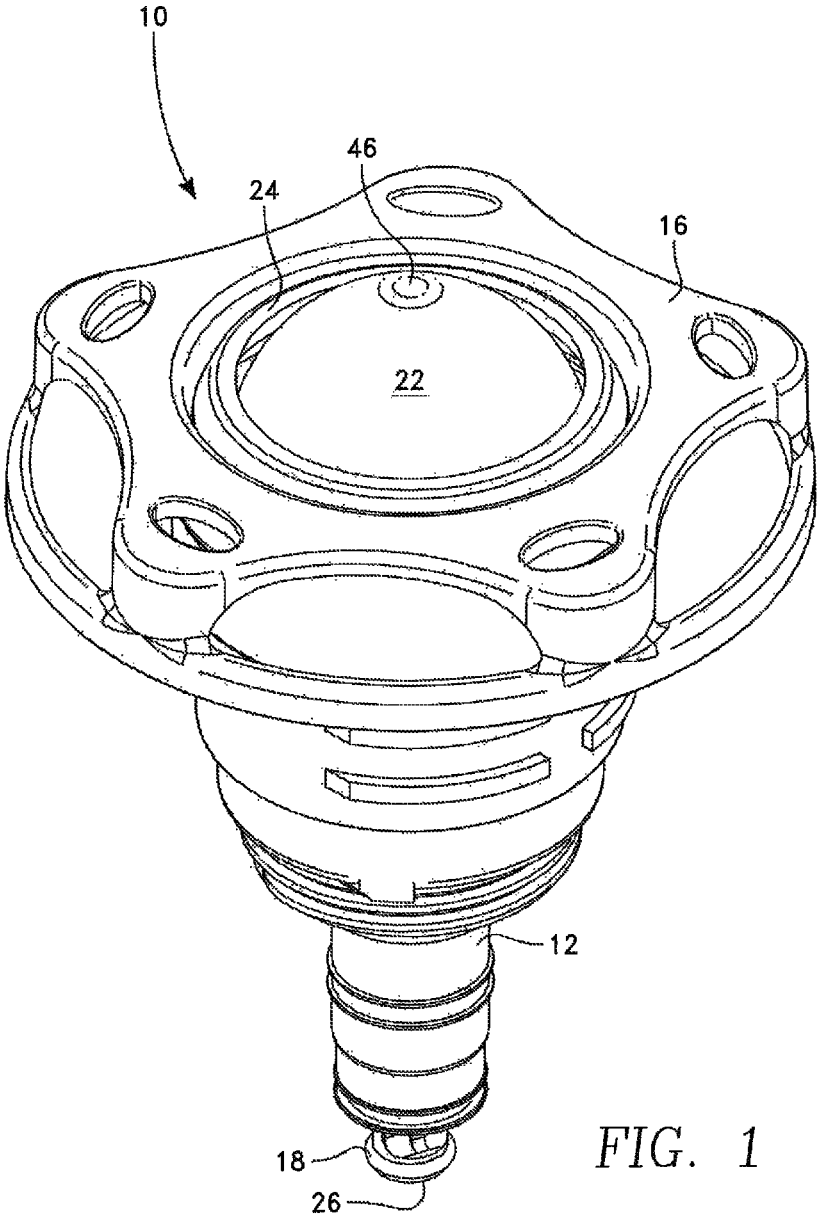
FIG. 1 shows a perspective top view of the preferred embodiment of the jet of the instant invention.

Turning to the drawings, the preferred embodiment is illustrated and described by reference characters that denote similar elements throughout the several views of the instant invention.

The preferred embodiment provides for a massager 10 that is actuated inside the hydrotherapy vessel by pressure applied by an occupant in the vessel.

An application of force or pressure that can be applied by the occupant against the actuation point 46 is translated into linear motion opposite the direction of the flow of pressurized water. This force opposes the water pressure at the influent side of the valve piston 26. The diameter of the valve piston 26 is sized to create a preferred resistance to the force applied by the occupant, as the surface area of the valve piston 26 relates to its diameter and is acted upon by the predetermined pressure of the hydraulic system of the hydrotherapy vessel. The intensity of the massage can be varied in an intuitive response to the massage by the occupant. When more force is applied by the occupant, more water can pass through the valve and provide a more vigorous massage.

The application of pressure by the body of the occupant to the front of the shuttle 22 of the massager 10 allows a valve piston 26 to open in the water flow inlet of the massaging jet 10 that allows pressurized water to enter the massaging jet 10, then onto the surface of the occupant's body thereby providing a massage. Once the occupant removes the pressure from the actuation point 46 of the massaging jet 10, the water pressure and flow cause the valve piston 26 to close.

This mechanism provides for increased energy efficiency as when the massaging jets 10 aren't being used, they are not operating and consuming energy. This also serves to reduce the unwanted sound caused by the unused jets. Furthermore, since all of the massaging jets 10 won't be operating without actuation, the ones that are actuated by the occupant will be provided with a higher water pressure and flow because it is focused and not spread among the unused jets. The system pressure may be maintained at a higher pressure since the pump will be better able to supply the lower flow required by having fewer jets actuated at a given time. The moving parts of the jet will have a longer life because there will be less wear and tear due to the selective use of jets that are only operating when actuated by the occupant or occupants.

Figure 2A:
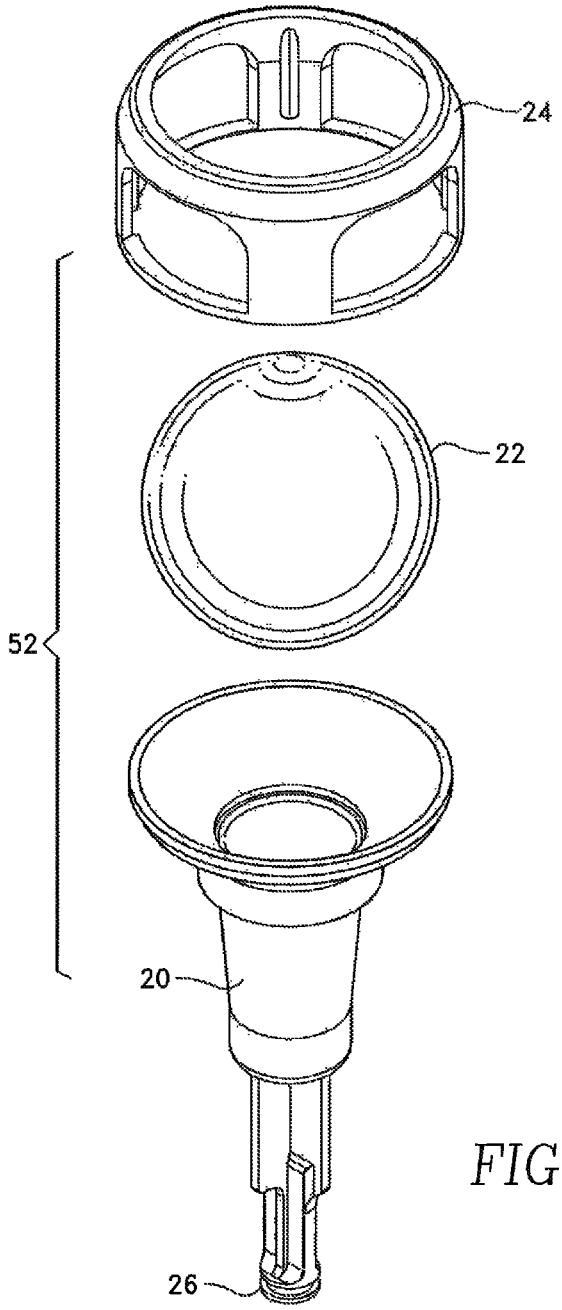
FIG. 2A shows an exploded view of the internal sleeve assembly of the preferred embodiment of the jet of the instant invention.
Figure 2B:
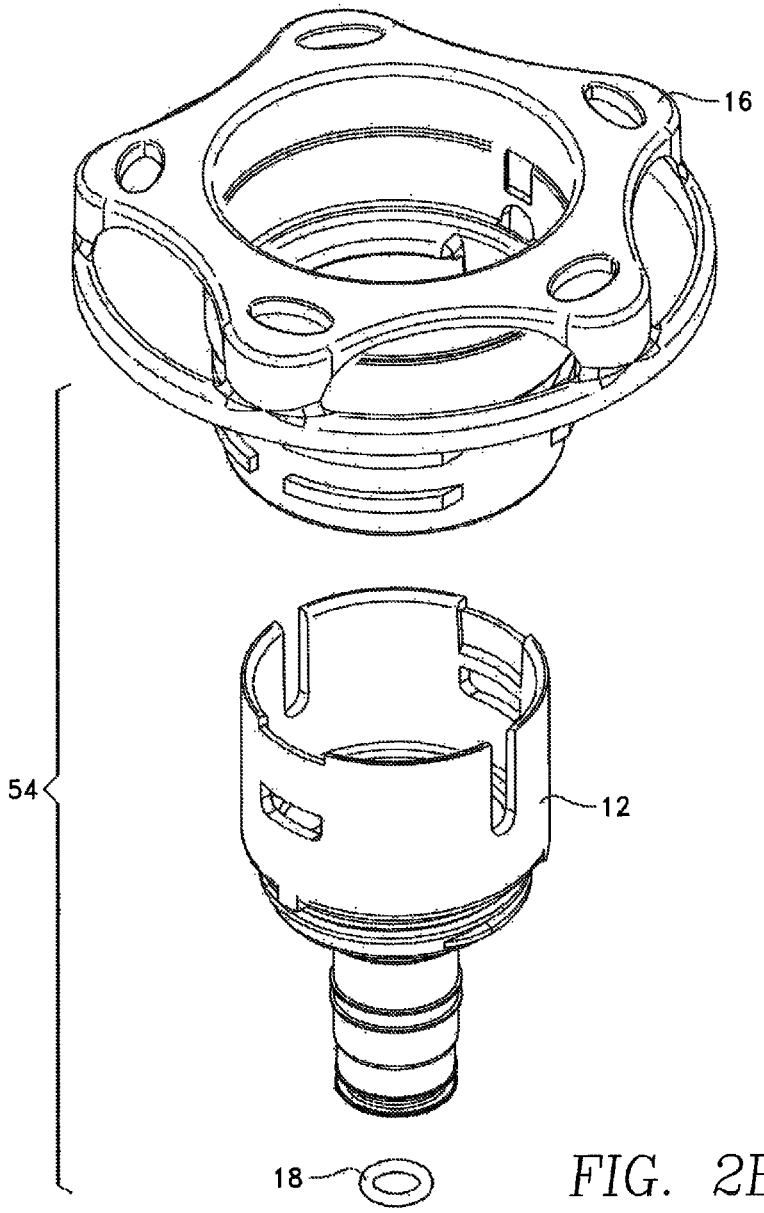
FIG. 2B shows an exploded view of the internal housing assembly of the preferred embodiment of the jet of the instant invention.

An exploded view of the two main portions of the preferred embodiment of the device are illustrated in FIGS. 2A-2B. FIG. 2A shows an exploded view of the internal sleeve assembly of the massaging jet 10 while FIG. 2B shows an exploded view of the internal housing assembly of the massaging jet 10. FIG. 1 shows a perspective view of the entire assembly of the preferred embodiment put together. Looking at FIG. 1, in the assembled configuration, the actuation point 46 for the activation of the massaging action is at the effluent side of the shuttle and is shown as a part of the shuttle 22 seated in the shuttle retainer 24 which sits in the escutcheon 16 of the device.

Figure 3A:
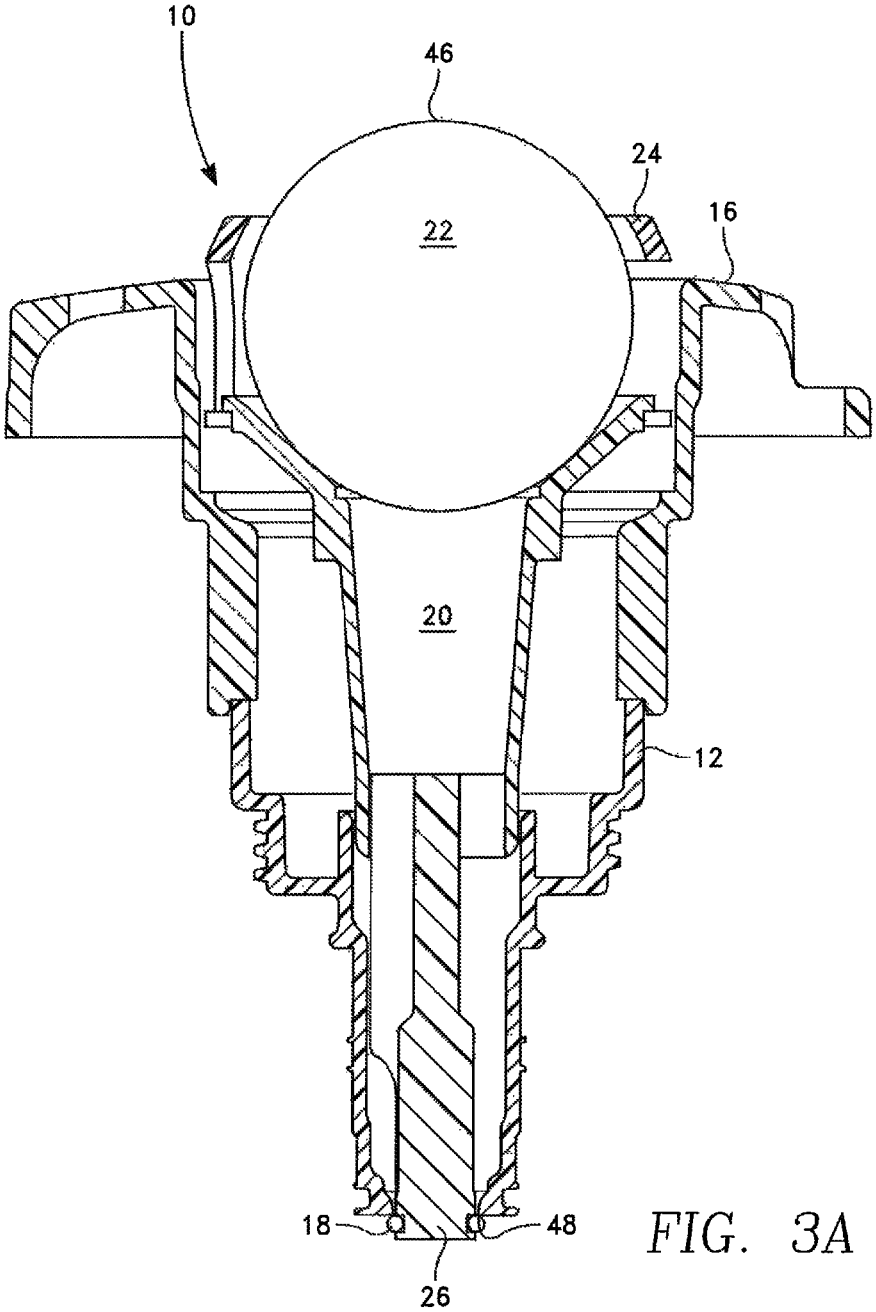
FIG. 3A shows a side cross sectional view of the preferred embodiment of the jet of the instant invention in the closed and unactuated position.
Figure 3B:
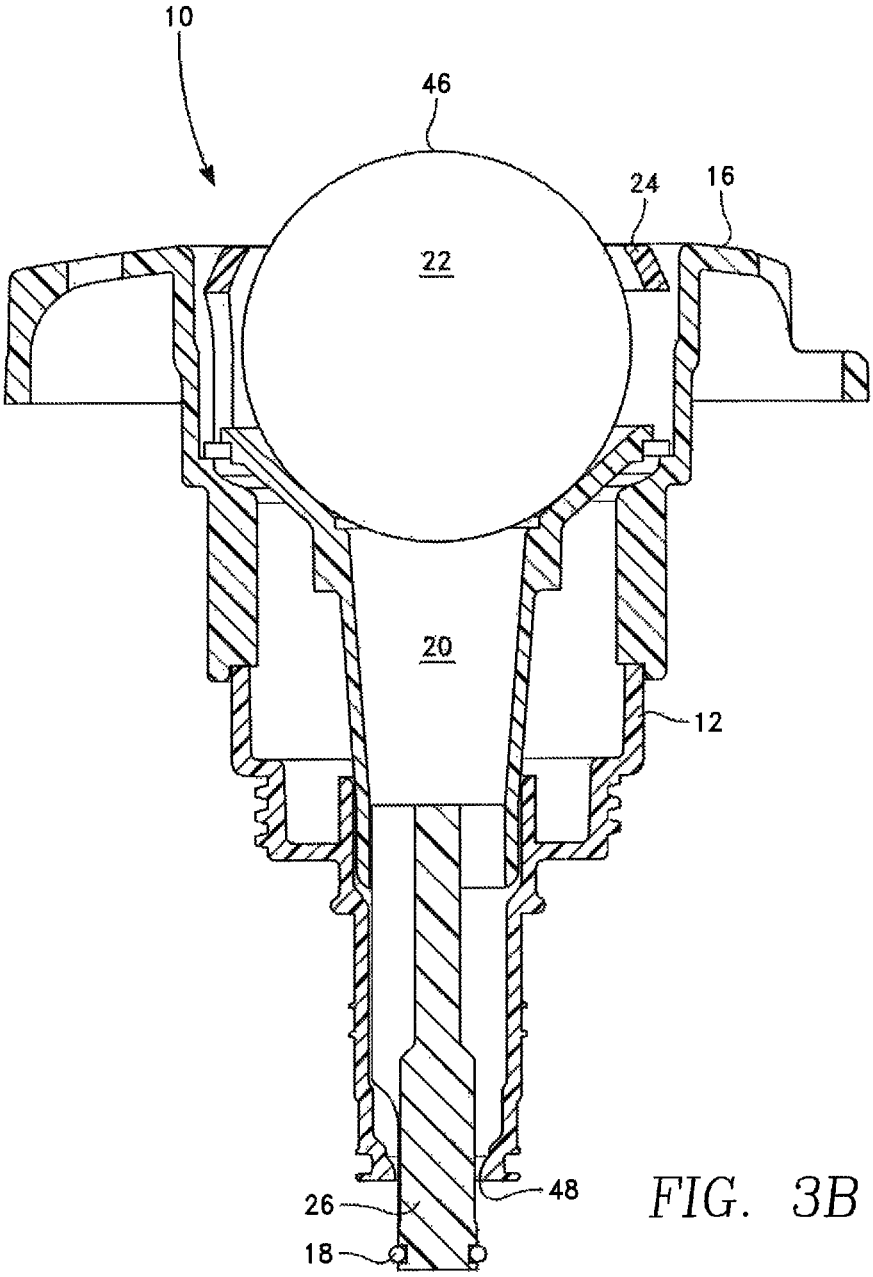
FIG. 3B shows a side cross sectional view of the preferred embodiment of the jet of the instant invention in the open and actuated position.

The device 10 consists of two assemblies, as seen in FIGS. 2A-2B. The internal sleeve assembly 52 sits inside of the internal housing assembly 54. The internal housing assembly 54 (FIG. 2B) includes the escutcheon 16 as the outermost component with the diffuser 12. A valve piston seal 18 is found below the diffuser and operates to connect the valve piston 26 and the valve seat 48. (See FIGS. 3A-3B.) The internal sleeve assembly 52 (FIG. 2A) includes at the bottom the valve piston 26 which is attached to the piston sleeve 20 on top of which sits the shuttle retainer 24 which houses the shuttle 22.

As described above, the massager 10 remains in the inoperable position (FIG. 3A) until actuated (FIG. 3B) when the valve piston 26 is disengaged from the valve seat 48. In use, the occupant would apply force to the actuation point 46 which applies pressure to the piston sleeve 20 and the valve piston 26 thereby separating the valve piston 26 and the valve piston seal 18 from the valve seat 48. The valve piston 26 is sealed to the valve seat 48 through a valve piston seal 18 thereby preventing a majority of movement of pressurized water through the diffuser 12 until actuated. The valve piston 26 is released from the valve seat 48 (FIG. 3B) when actuated at the actuation point 46 thereby allowing pressurized water to flow therethrough.

Figure 4:
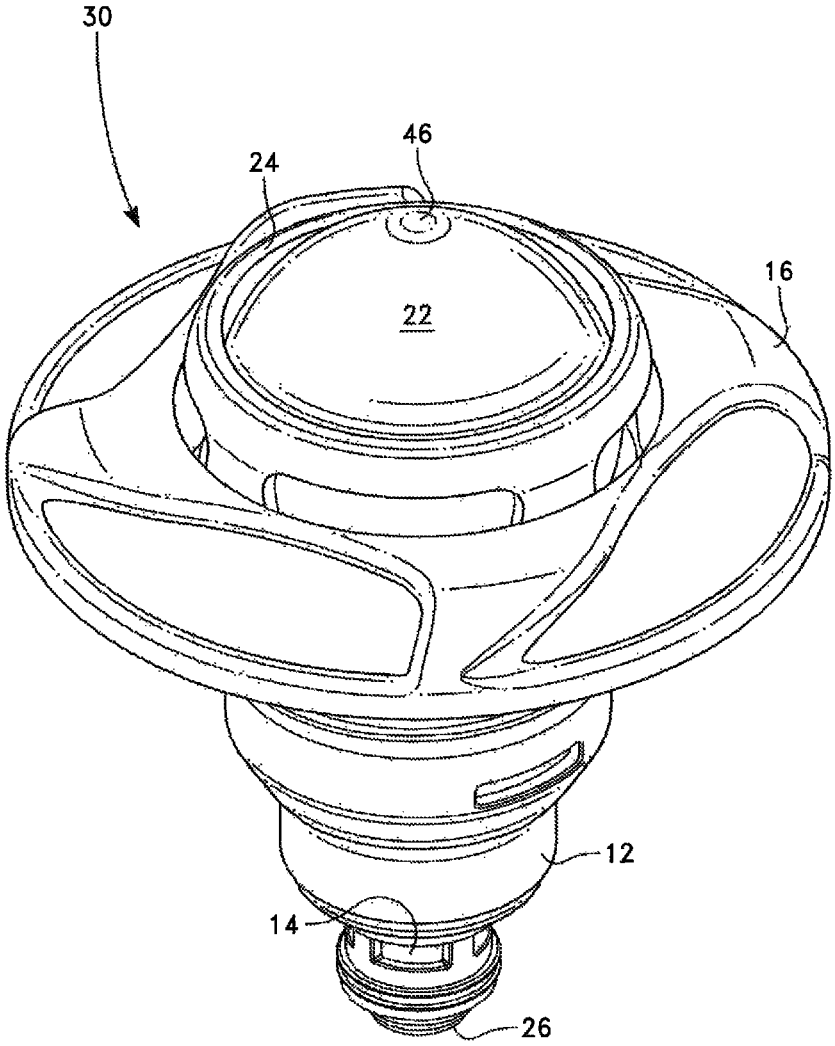
FIG. 4 is a top perspective view of an alternate embodiment of the jet of the instant invention.
Figure 5A:
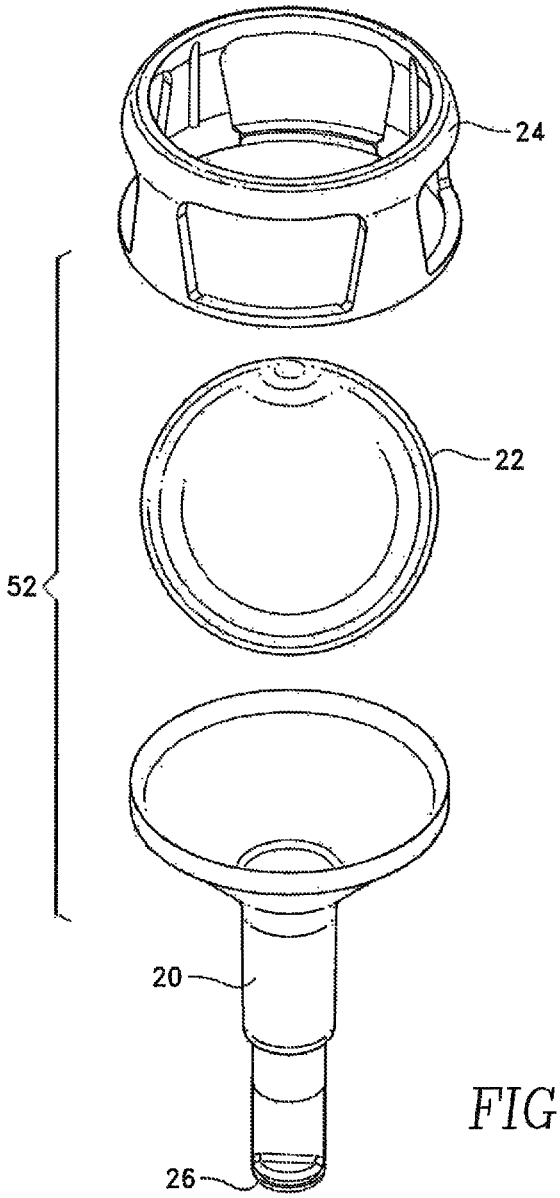
FIG. 5A shows an exploded view of the internal sleeve assembly of the first alternate embodiment of the jet of the instant invention.
Figure 5B:
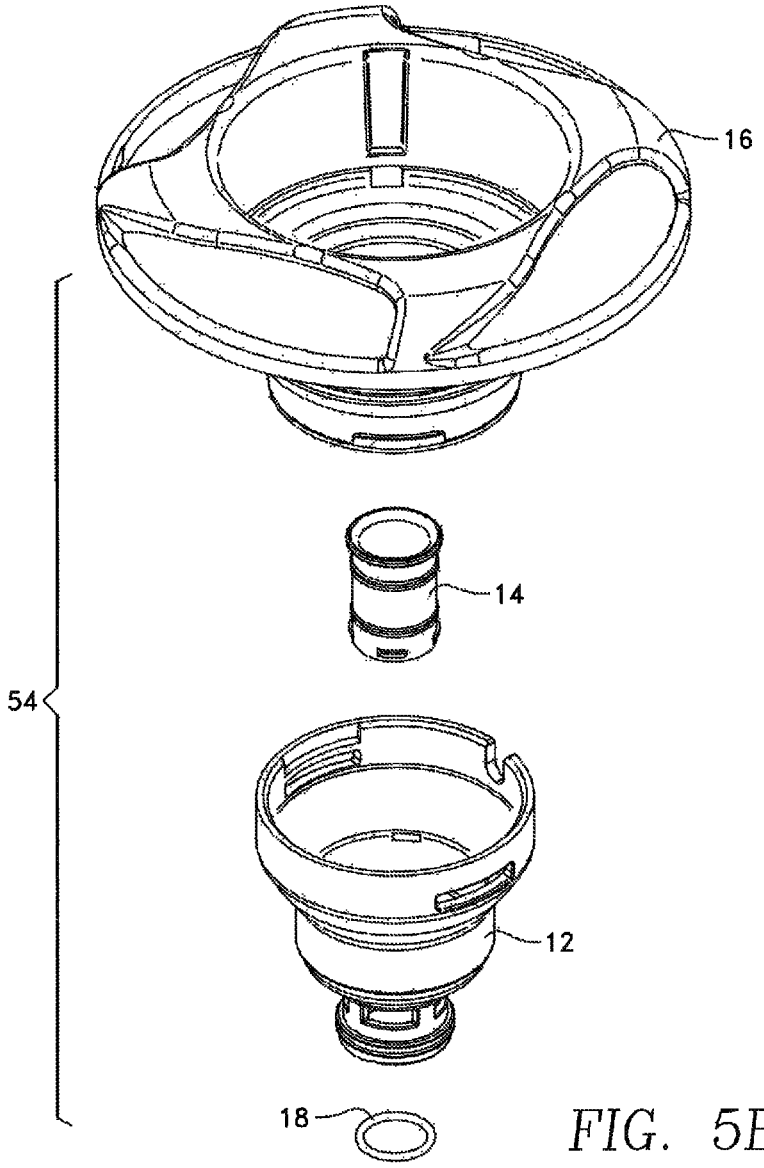
FIG. 5B shows an exploded view of the internal housing assembly of the first alternate embodiment of the jet of the instant invention.
Figure 6A:
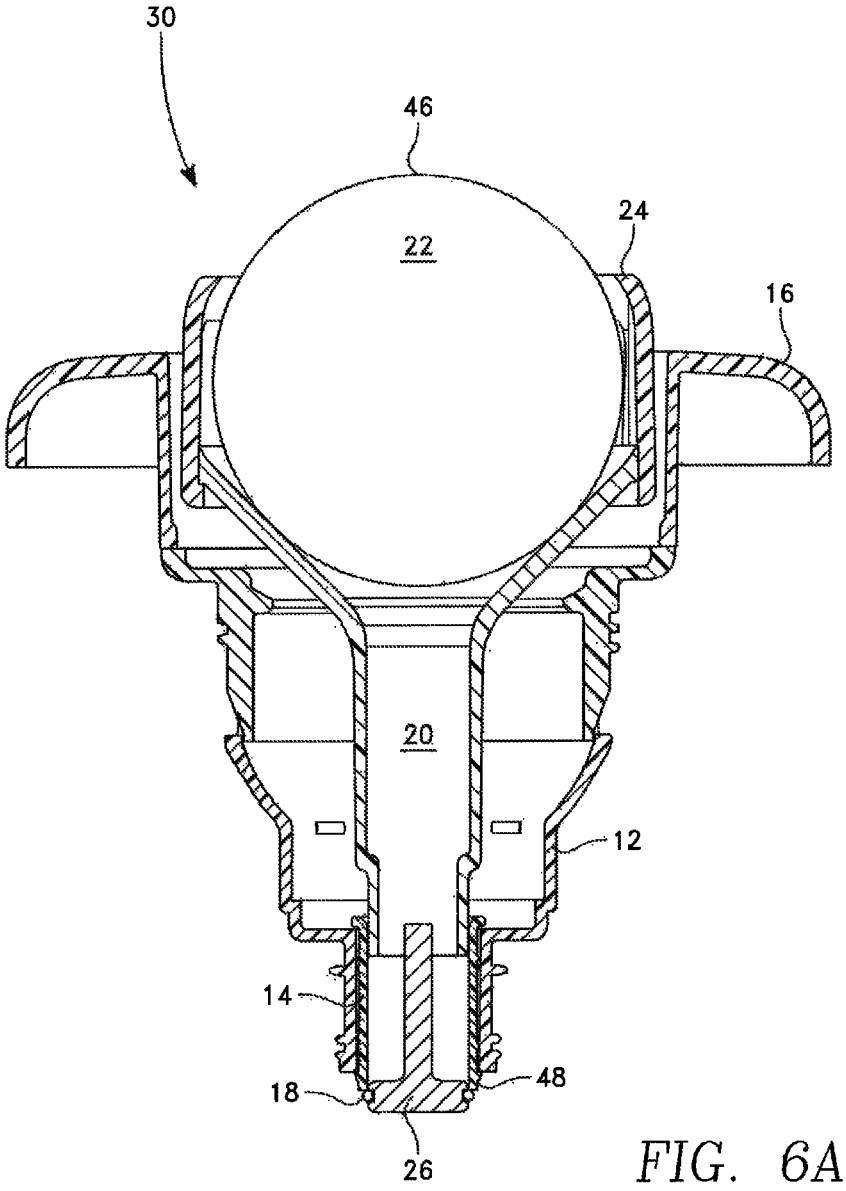
FIG. 6A shows a side cross sectional view of the first alternate embodiment of the jet of the instant invention in the closed and unactuated position.
Figure 6B:
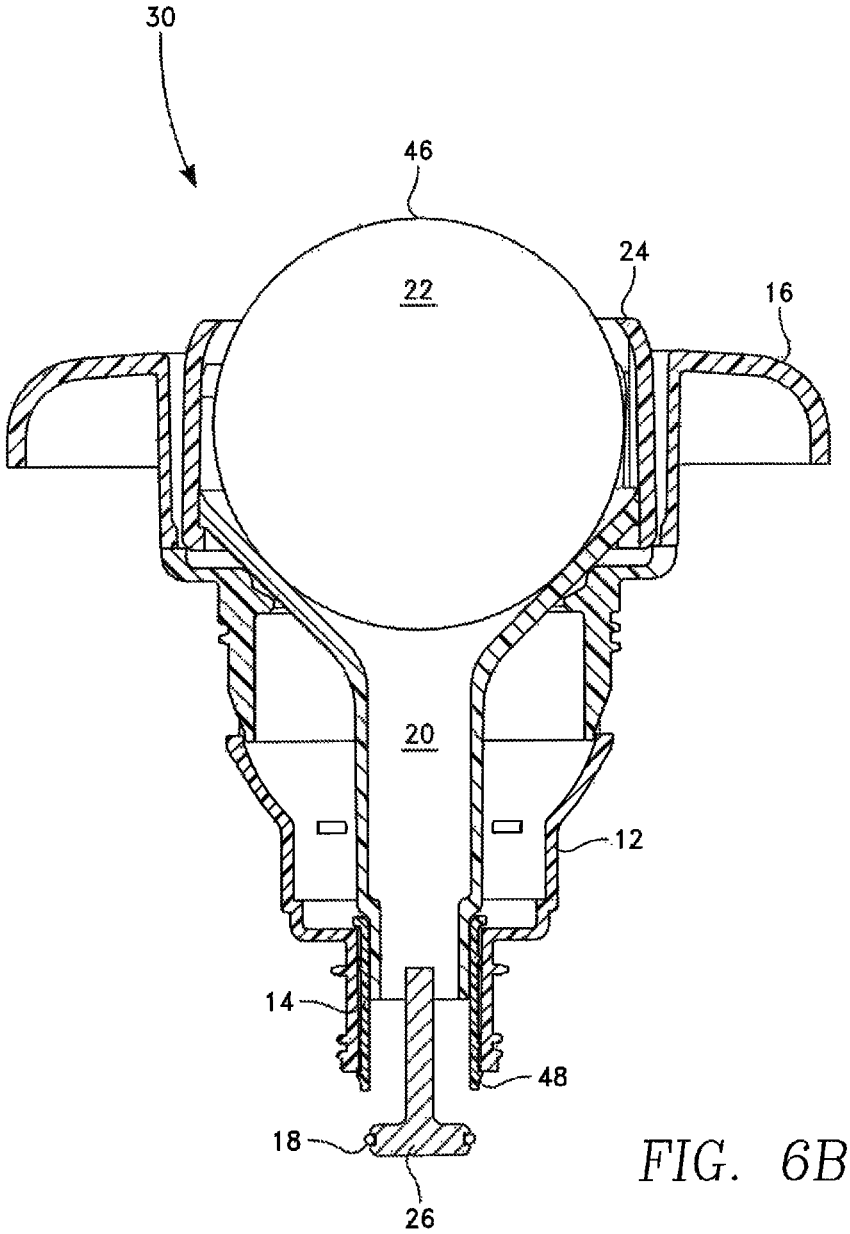
FIG. 6B shows a side cross sectional view of the first alternate embodiment of the jet of the instant invention in the open and actuated position.

An alternate embodiment 30 (FIG. 4) as shown in FIGS. 5-6B. Below the escutcheon 16 in the alternate embodiment 30 is the diffuser 12 which has housed inside of it the valve seat adapter 14. The valve piston 26 extends from the valve seat adapter 14. The preferred embodiment 10 has this valve seat incorporated as part of the diffuser 12 instead of requiring a separate valve seat adapter to provide the valve seat, but remains an option in this first alternate embodiment of the instant invention. The first alternate embodiment uses an existing diffuser 12 which requires a separate component to create the valve seat 48. The preferred embodiment 10 uses a customized diffuser. Furthermore, as illustrated, each embodiment has a different decorative look to the escutcheon 16.

Figure 7:
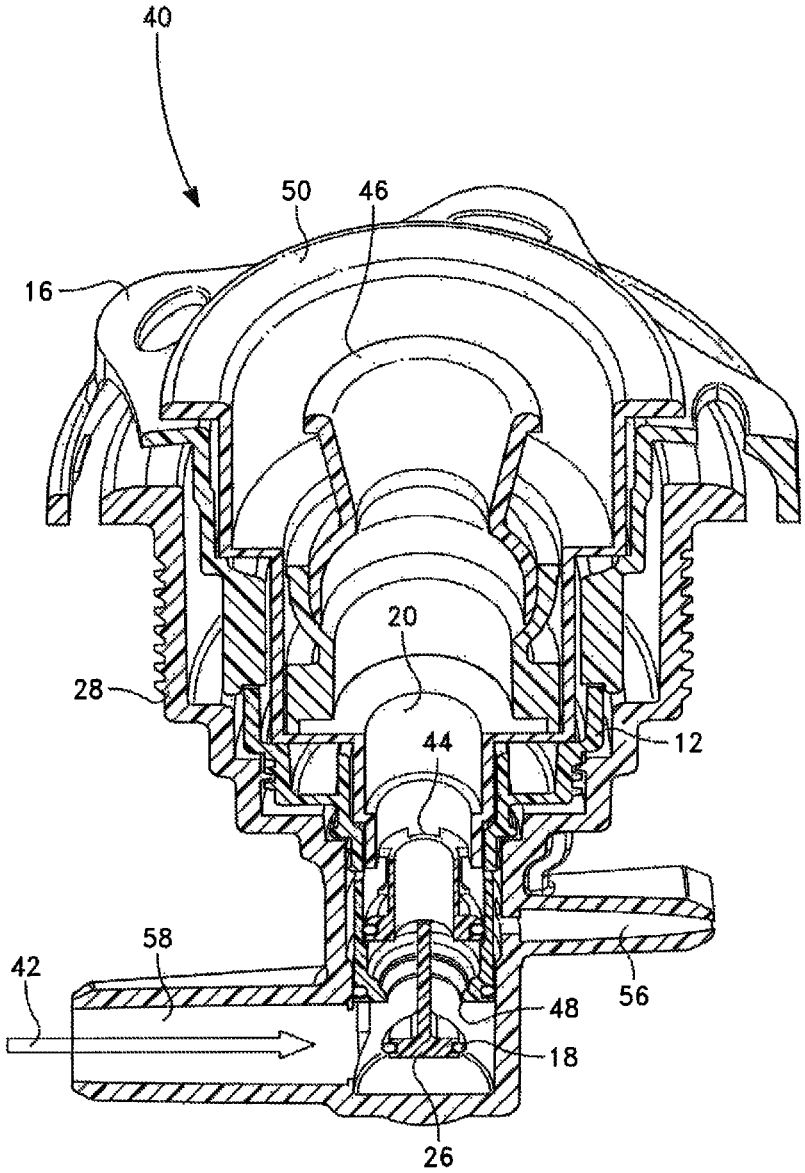
FIG. 7 is a side cross sectional view of a second alternate embodiment of the jet of the instant invention.

A second alternate embodiment 40 is shown in FIG. 7. In this embodiment 40, the actuation surface 46 can be a ring around the directional water nozzle style of hydrotherapy massage apparatus rather than the shuttle 22. Additionally, this embodiment includes an escutcheon extension 50 which can also act as an actuation point 46. Further, this embodiment includes a venturi 44 to introduce air via the air port 56 into the water flow 42 provided by way of the waterport 58 in a mounting body 28. Alternate hydrotherapy apparatuses such as a rotating water nozzle would benefit from the type of actuation surface 46 located on the escutcheon extension 50 described in the second alternate embodiment 40 and may be supplemented in place of the directional nozzle in FIG. 5.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An occupant-actuated system for a hydrotherapy vessel comprising:

a hydrotherapy vessel for the containment of water for the submersion therein of a human occupant;

a pump;

two or more jets attached to said pump, each of said two or more jets further comprising:

an internal housing assembly further comprising:

a valve seat;

an internal sleeve assembly housing inside of said internal housing assembly further comprising:

a piston sleeve;

a valve piston at the bottom of said piston sleeve;

a valve piston seal between said valve piston and said piston sleeve;

a shuttle that is an actuation point that acts as a point of massage for said human occupant contactable with said piston sleeve;

wherein when pressure is applied to said shuttle by said human occupant, pressure is further applied to said piston sleeve thereby causing said valve piston and said valve piston seal to separate from said valve seat thereby allowing the flowing of pressurized water therethrough and wherein when pressure on said shuttle is released said flowing of pressurized water is discontinued.

2. An occupant-actuated system for a hydrotherapy vessel comprising:

a hydrotherapy vessel for the containment of water for the submersion therein of a human occupant;

a pump;

two or more jets attached to said pump, each of said two or more jets further comprising:

an internal housing assembly further comprising:

a valve seat;

an internal sleeve assembly housing inside of said internal housing assembly further comprising:

a piston sleeve;

a valve piston at the bottom of said piston sleeve;

a valve piston seal between said valve piston and said piston sleeve;

an escutcheon;

an escutcheon extension that is an actuation point that acts as a point of massage for said human occupant contactable with said piston sleeve;

wherein when pressure is applied to said escutcheon extension by said human occupant, pressure is further applied to said piston sleeve thereby causing said valve piston and said valve piston seal to separate from said valve seat thereby allowing the flowing of pressurized water therethrough and wherein when pressure on said escutcheon extension is released said flowing of pressurized water is discontinued.

3. An occupant-actuated system for a hydrotherapy vessel comprising:

a hydrotherapy vessel for the containment of water for the submersion therein of a human occupant;

a pump;

two or more jets attached to said pump, each of said two or more jets further comprising:

an internal housing assembly further comprising:

a valve seat;

an internal sleeve assembly housing inside of said internal housing assembly further comprising:

a piston sleeve;

a valve piston at the bottom of said piston sleeve;

a valve piston seal between said valve piston and said piston sleeve;

a hydrotherapy massage apparatus that is an actuation point that acts as a point of massage for said human occupant contactable with said piston sleeve;

wherein when pressure is applied to said hydrotheraphy massage apparatus by said human occupant, pressure is further applied to said piston sleeve thereby causing said valve piston and said valve piston seal to separate from said valve seat thereby allowing the flowing of pressurized water therethrough and wherein when pressure on said hydrotherapy massage apparatus is released said flowing of pressurized water is discontinued.

4. The occupant-actuated system for a hydrotherapy vessel as defined in claim 1 wherein said valve piston is sized to create resistance to said force applied by said occupant as the surface area of said valve piston relates to its diameter and is acted upon by a predetermined water pressure in said hydrotherapy vessel.

5. The occupant-actuated system for a hydrotherapy vessel as defined in claim 2 wherein said valve piston is sized to create resistance to said force applied by said occupant as the surface area of said valve piston relates to its diameter and is acted upon by a predetermined water pressure in said hydrotherapy vessel.

6. The occupant-actuated system for a hydrotherapy vessel as defined in claim 3 wherein said valve piston is sized to create resistance to said force applied by said occupant as the surface area of said valve piston relates to its diameter and is acted upon by a predetermined water pressure in said hydrotherapy vessel.

* * * * *